United States Patent [19]

Ehrenhalt et al.

[11] Patent Number: 4,868,533

[45] Date of Patent: Sep. 19, 1989

[54] TRANSFORMER WITH A ONE-PIECE PRIMARY WINDING AND HOUSING

[75] Inventors: Dan Ehrenhalt, Buffalo; George R. Giles, Getzville, both of N.Y.

[73] Assignee: LTV Aerospace & Defense Company, Buffalo, N.Y.

[21] Appl. No.: 312,318

[22] Filed: Feb. 16, 1989

Related U.S. Application Data

[63] Continuation of Ser. No. 156,184, Feb. 16, 1988, abandoned.

[51] Int. Cl.[4] ..... H01F 27/30

[52] U.S. Cl. ..... 336/82; 336/94; 336/223; 336/229

[58] Field of Search ..... 336/82, 173, 174, 175, 336/223, 229, 90, 92, 94

[56] References Cited

U.S. PATENT DOCUMENTS

| | | | |
|---|---|---|---|
| 1,199,092 | 9/1916 | Mack | 336/82 |
| 1,953,779 | 4/1934 | Sclater et al. | 336/82 |
| 1,986,884 | 1/1935 | Fassler | 336/82 |
| 2,599,086 | 6/1952 | Beckius et al. | 336/82 X |
| 2,655,623 | 10/1953 | Parker | 336/82 |
| 2,785,265 | 3/1957 | Salisbury | 336/82 X |
| 2,901,714 | 8/1959 | Baker | 336/82 |
| 3,353,130 | 11/1967 | Silverstein | 336/82 |
| 3,629,759 | 12/1971 | Douglas et al. | 336/82 |
| 4,379,273 | 4/1983 | Bender | 336/82 |

*Primary Examiner*—Thomas J. Kozma

*Attorney, Agent, or Firm*—Brooks & Kushman

[57] ABSTRACT

Described is a transformer wherein the primary winding is formed from the same unitary piece of electrically conductive metal that comprises the housing of the transformer.

12 Claims, 2 Drawing Sheets

TRANSFORMER WITH A ONE-PIECE PRIMARY WINDING AND HOUSING

This is a continuation of co-pending application Ser. No. 156,184, filed on 2-16-88, now abandoned.

TECHNICAL FIELD

The present invention relates generally to transformers, and more particularly to a transformer with a one piece primary winding and housing formed from a unitary piece of electrically conductive metal.

BACKGROUND OF THE INVENTION

Electrical devices which transform electric energy from one or more circuits to one or more other circuits through electromagnetic induction are commonly referred to as transformers. Generally, a transformer consists of two or more windings (primary and secondary, etc.) interlinked by a mutual magnetic field.

The usefulness of a transformer lies in the fact that electrical energy can be transferred from one circuit to another without direct connection, and in the process can be readily changed from one voltage level to another. Transformers are widely used in low-power, low-current applications where a large power output is required. The power output is determined by the turns ratio between the primary and secondary windings. By properly proportioning the numbers of primary and secondary turns, any desired voltage ratio, or ratio of transformation can be obtained.

A problem encountered in the field of transformers is that there is always some power loss in the resistance of the coils and in the core. As a result, the power taken from the input or source will usually exceed that taken from the secondary coil. Although power losses may be reduced by decreasing the number of turns in the coils, this approach is usually self-defeating since the voltage induced in the coils is proportional to the number of turns in the coils.

One previously known means for reducing power losses and improving the efficiency of transformers is shown in U.S. Pat. No. 1,790,906 to Eckman. In that patent, a transformer is disclosed in which the primary coil is entirely enclosed by an outer housing which also forms the secondary winding of the transformer.

Similarly, U.S. Pat. No. 2,553,665 to McKechnie discloses a transformer having a secondary winding formed from a one piece casting which has at least two complete turns. Like the Eckman transformer, The McKechnie transformer also discloses an outer housing formed from the secondary winding.

Lastly, U.S. Pat. No. 512,603 to Coffin discloses a transformer having a one piece secondary winding.

Each of the above patents discloses a transformer which incorporates a one-piece secondary winding and housing. This design improves efficiency and prevents contamination of the coils by foreign material. However, each design still requires a multiturn primary winding and a large input voltage to produce the desired power output.

It would be highly desirable to design a transformer that is highly power efficient and does not require a large input voltage or a multi-turn primary winding.

SUMMARY OF THE INVENTION

The present invention addresses the power loss mechanisms inherent in conventional transformer designs: the loss of power in the resistance of the coils and in the core.

In accordance with the present invention, there is disclosed herein a step-up transformer for use in cooperation with an FET modulator which is relatively small, can produce variable pulse widths and requires a low input voltage. The transformer of the present invention is designed to function as an integral part of an FET modulator and is further characterized by having low resistance and low series inductance.

The transformer comprises a one-piece primary winding and housing wherein the primary winding is formed from the same unitary piece of metal that comprises the housing of the transformer.

BRIEF DESCRIPTION OF THE DRAWINGS

The present invention will be more clearly understood by reference to the following detailed description of the preferred embodiment when read in conjunction with the accompanying drawings in which like reference characters refer to like parts throughout the views and in which.

DETAILED DESCRIPTION OF THE INVENTION

Figure 1:
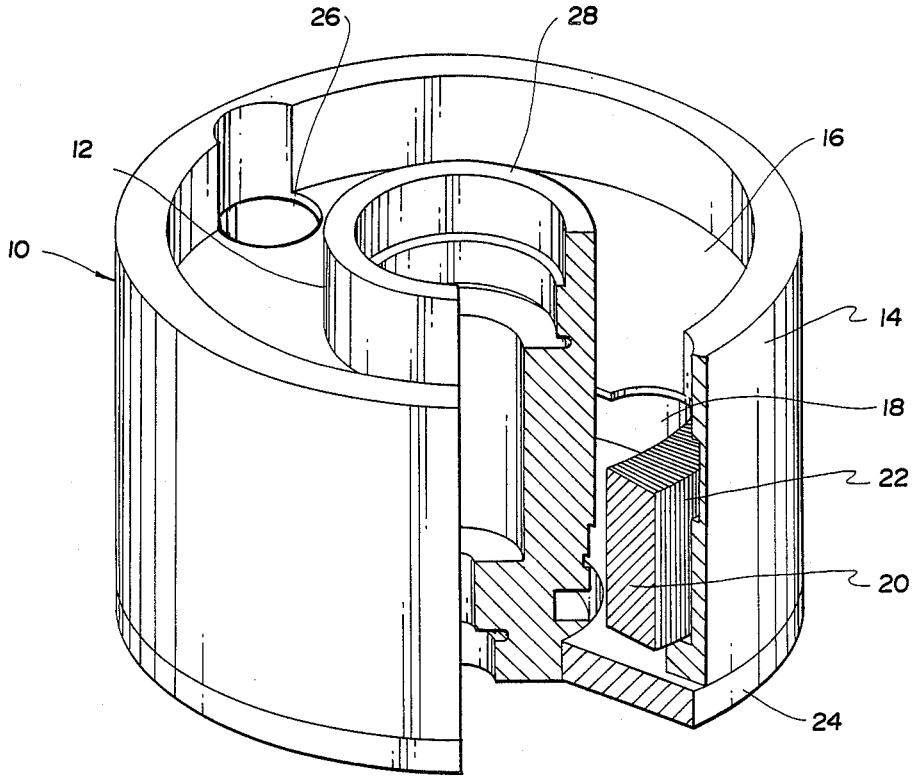
FIG. 1 is a perspective view partially broken away and in cross section of a transformer constructed in accordance with the present invention.
Figure 2:
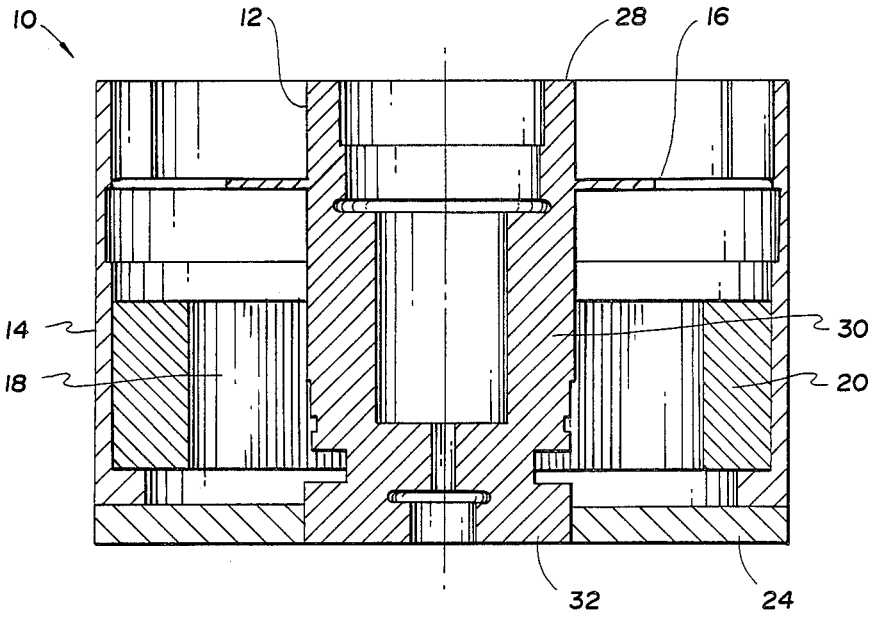
FIG. 2 is a sectional view of a transformer constructed in accordance with the present invention.

The invention will be more clearly understood by referring to FIG. 1 which depicts a transformer for use in a microwave tube modulator generally referred to by reference numeral 10. A microwavy tube modulator is a device that can deliver the high voltage pulses that are required for the anode/cathode circuit of a microwave tube. Modulators are used to drive microwave tubes like magnetrons, pulse cavity oscillators, cross field amplifiers and travelling wave tubes. A modulator, microwave tube and a power supply form a pulse microwave transmitter. In operation, the modulator will receive a pulse form a pulse generator, and will produce the proper pulse for the microwave tube.

The transformer disclosed herein is designed to coupled with a group of field effect transistors to create the high voltage pulse that is required for a microwave tube. In accordance with the present invention, the transformer 10 includes an elongated primary winding 12 and outer housing 14. Both the primary winding and the hsouing are machined from the same unitary piece of copper. Also machined from the same unitary piece of copper is a top cap 16 which is located between the primary winding 12 and the housng 14. The outer housing 14 is axially displaced about the primary winding 12 and is preferably cylindrical.

Referring again to FIG. 1, a cavity 18 is machined from the same unitary piece of copper which forms the primary winding 12, the outer housing 14, and the top cap 16. Thus, the primary winding 12, the outer housing 14, and the top cap 16 comprise one piece of copper.

Still further, according to the present invention, there is disclosed a core 20 which is axially displaced about the primary winding 12 and within the transformer cavity 18. Wound about the core are secondary windings 22.

Figure 3:
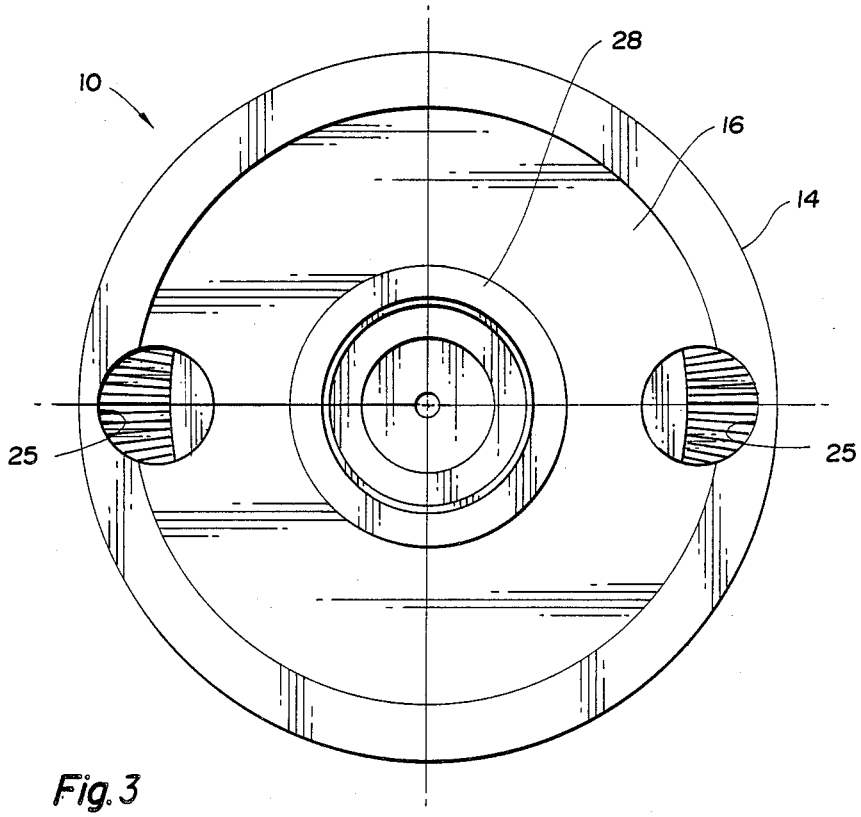
FIG. 3 is a plan view of the transformer shown in FIGS. 1 and 2.

Contacting the outer housing 14 and the primary winding 12 is a bottom cap 24. This cap is placed contiguous with the housing 14 and below the core 20 to form a lower seal between the primary winding 12 and housing 14. The inner cavity 18 shown in FIGS. 1 and 3 may be filled with a material such as oil to prevent arching. Also, shown in FIGS. 1 and 3, openings 26 are stamped atop the top cap 16 to form an exit for the wires from the secondary winding.

As previously set forth, the primary winding and housing of the transformer are machined from the same unitary piece of copper. In production, the top portion of the transformer is machined to form the top interface of the primary winding 28. Thereafter, the copper is machined to form the top cap 16 disposed between the top interface of the primary winding 28 and the outer housing of the transformer 14. A center section of the primary winding 30 is then machined from the bottom side of the copper defining a core cavity 18 between the outer housing 14, the top cap 16, and said center portion 30.

Lastly, the bottom interface of the primary winding 32 is machined. The top and bottom interfaces of the primary winding 28 and 32 form electrical and mechanical interfaces to the FET modulator. As a final production step, the core 20 with secondary windings 22 is placed within the core cavity 18 and a bottom cap 24 is fixably attached to the underside of the outer housing 14. Bottom cap 24 forms a lower seal between the center section of the primary winding 30 and the outer housing 14.

As set forth above, the transformer disclosed is coupled to a group of high power field effect transistors. The FET's are grouped in four quadrants. Each quadrant has all the necessary driver circuits to drive the FET's that are in the primary circuit of the output transformer. The primary winding 12 of the transformer 10 is machined at the upper end 28 and the lower end 32 to form electrical and mechanical interfaces to the quadrants.

As a preferred embodiment of the present invention, the transformer has a very high turns ratio between the secondary and the primary windings. A high current (2600–3000 amperes) pulse at the primary produces a high voltage pulse at the secondary. The high current pulse is produced by the group of power FET's in parallel.

By incorporating a single turn non-reentrant primary winding within the transformer, the conductor provides a current path with minimum resistance and minimum inductance so that a 3000 ampere pulse with a fast raise and fall time may be carried easily.

In operation, the current flows from the top interface of the primary winding 28 through the primary winding 12 (once) to the bottom interface 32. Voltage is thus induced upon the secondary winding providing substantial power output for the pulse microwave transmitter.

What is claimed is:

1. A transformer for use in cooperation with an FET modulator comprising:

a one piece, single turn non-reentrant elongated primary winding and housing surrounding the primary winding formed in a unitary piece of electrically conductive metal;

a secondary winding surrounding at least a portion of the primary winding and within the housing;

a top cap formed in the unitary piece of electrically conductive metal and located intermediate the length of the housing and above the secondary winding connecting the housing and the primary winding to form an upper seal;

a bottom cap located below the secondary winding and forming a lower seal between the primary winding and the housing to define a core cavity between the top and bottom caps;

the primary winding having top and bottom surfaces which form electrical and mechanical interfaces when used in cooperation with the FET modulator.

2. A transformer as defined in claim 1, wherein the primary winding, the top cap and the housing are formed in a unitary piece of copper.

3. A transformer as defined in claim 1, wherein the primary winding and housing are cylindrical.

4. A transformer as defined in claim 1, wherein the core cavity between the top and bottom caps is filled with material to prevent arcing.

5. In a transformer the improvement comprising:

a one piece, single turn non-reentrant primary winding having a top surface and a bottom surface and housing surrounding the primary winding formed in a unitary piece of electrically conductive metal;

a top cap formed in the unitary piece of electrically conductive metal and located intermediate the length of the housing and extending from at least a portion of the primary winding connecting the primary winding to the housing; and a secondary winding located below the top cap and surrounding at least a portion of the primary winding and within the housing.

6. A transformer as defined in claim 5, wherein the primary winding, the top cap and the housing are formed in unitary piece of copper.

7. A transformer as defined in claim 5, wherein the primary winding is cylindrical.

8. A transformer as defined in claim 5, wherein the primary winding is elongated.

9. A transformer as defined in claim 5, wherein the housing is cylindrical.

10. A transformer as defined in claim 5, having a bottom cap located below the secondary winding and forming a lower seal between the primary winding and the housing to define a core cavity between the top and bottom caps.

11. A transformer as defined in claim 10, wherein the core cavity is filled with material to prevent arcing.

12. A transformer as defined in claim 5, wherein the primary winding top and bottom surfaces form electrical and mechanical interfaces when used in cooperation with an FET modulator.

* * * * *

UNITED STATES PATENT AND TRADEMARK OFFICE

CERTIFICATE OF CORRECTION

PATENT NO. : 4,868,533

DATED : September 19, 1989

INVENTOR(S) : DAN EHRENHALT et al.

It is certified that error appears in the above-identified patent and that said Letters Patent is hereby corrected as shown below:

| | |
|---|---|
| Column 2, Line 37, | "microwavy" should be --microwave--; |
| Column 2, Line 45, | "form" should be --from--; |
| Column 2, Lines 47/48, | "coupled" should be --couple--; |
| Column 2, Line 53, | "hsouing" should be --housing--; |
| Column 2, Line 56, | "housng" should be --housing-- |
| Column 3, Line 20, | "portion" should be --section--; |
| Column 4, Claim 6, Line 43, | After "in" insert --a--. |

Signed and Sealed this

Ninth Day of April, 1991

*Attest:*

*Attesting Officer*

HARRY F. MANBECK, JR.

*Commissioner of Patents and Trademarks*